US010133227B2

(12) United States Patent
Kunihisa

(10) Patent No.: US 10,133,227 B2
(45) Date of Patent: Nov. 20, 2018

(54) IMAGE FORMING APPARATUS WHICH CONTROLS TONER ADHESION AMOUNT

(71) Applicant: Konica Minolta, Inc., Tokyo (JP)

(72) Inventor: Teppei Kunihisa, Hamamatsu (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/352,762

(22) Filed: Nov. 16, 2016

(65) Prior Publication Data

US 2017/0139366 A1 May 18, 2017

(30) Foreign Application Priority Data

Nov. 18, 2015 (JP) ..... 2015-225480

(51) Int. Cl.
*G03G 15/00* (2006.01)
*G03G 15/06* (2006.01)

(52) U.S. Cl.
CPC ..... *G03G 15/556* (2013.01); *G03G 15/5058* (2013.01); *G03G 15/065* (2013.01); *G03G 2215/00059* (2013.01)

(58) Field of Classification Search
None
See application file for complete search history.

(56) References Cited

U.S. PATENT DOCUMENTS

2004/0057739 A1* 3/2004 Shimura ..... G03G 15/5041 399/49
2011/0044705 A1 2/2011 Akashi et al.
2011/0222870 A1 9/2011 Miyagi
2013/0236200 A1 9/2013 Tanaka

FOREIGN PATENT DOCUMENTS

JP 2006047349 A 2/2006
JP 2006113540 A * 4/2006
JP 2006-343679 A 12/2006
JP 2011154146 A 8/2011
JP 2012-058650 A 3/2012
JP 2012058650 A 3/2012
JP 2012-230312 A 11/2012
JP 2013-218284 A 10/2013

OTHER PUBLICATIONS

JP_2006343679_A_T MachineTranslation, Arai, Japan, Dec. 2006.*
(Continued)

*Primary Examiner* — Victor Verbitsky
(74) *Attorney, Agent, or Firm* — Lucas & Mercanti, LLP

(57) ABSTRACT

An image forming apparatus forms test patches, and detects the adhesion amounts of toner in the test patches. The image forming apparatus calculates an approximate equation approximates the relationship between a developing bias and an adhesion amount of toner, based on the developing biases when the test patches were formed and the adhesion amounts of toner of the test patches. Distance between test patches is {(2n−1)/2} times of value L, where n is a natural number and L is a length of the photo conductor drum in a circumferential direction. The accuracy of toner adhesion amount control can be improved, and image density can be stabilized.

19 Claims, 22 Drawing Sheets

(56) References Cited

OTHER PUBLICATIONS

JP_2012230312_A_T MachineTranslation, Harashima, Japan, Nov. 2012.*
JP_2006113540_A_T MachineTranslation, Japan, Watanabe, 2006.*
Notification of Reasons for Refusal dated Oct. 24, 2017 from Japanese Application No. JP 2015-225480 and English translation.
Office Action dated Mar. 29, 2018 from European Application No. EP 16199286.2.
Extended European Search Report dated Mar. 24, 2017 from European Application No. 16199286.2.

* cited by examiner

FIG. 20

| | | CONTROL RESULT | |
|---|---|---|---|
| | | DEVELOPING BIAS [V] | TONER ADHESION AMOUNT [g/m$^2$] |
| COMPARATIVE EXAMPLE | APPROXIMATE BY LEAST SQUARES FROM DETECTED ADHESION AMOUNT | 459 | 3.9 |
| EMBODIMENT 1 | APPROXIMATE BY LEAST SQUARES FROM DETECTED ADHESION AMOUNT OF PATCHES AT INTERVALS OF 1/2 TIMES OF CIRCUMFERENTIAL LENGTH | 464 | 3.95 |
| EMBODIMENT 2 | APPROXIMATE BY LEAST SQUARES FROM DETECTED ADHESION AMOUNT OF PATCHES AT INTERVALS OF 1/2 TIMES OF CIRCUMFERENTIAL LENGTH AND MIDPOINTS | 465 | 3.96 |

FIG. 22

| | | REPETITION DISPERSION $6\sigma$ [g/m$^2$] |
|---|---|---|
| COMPARATIVE EXAMPLE | APPROXIMATE BY LEAST SQUARES FROM DETECTED ADHESION AMOUNT | 0.29 |
| EMBODIMENT 1 | APPROXIMATE BY LEAST SQUARES FROM DETECTED ADHESION AMOUNT OF PATCHES AT INTERVALS OF 1/2 TIMES OF CIRCUMFERENTIAL LENGTH | 0.20 |
| EMBODIMENT 2 | APPROXIMATE BY LEAST SQUARES FROM DETECTED ADHESION AMOUNT OF PATCHES AT INTERVALS OF 1/2 TIMES OF CIRCUMFERENTIAL LENGTH AND MIDPOINTS | 0.17 |

IMAGE FORMING APPARATUS WHICH CONTROLS TONER ADHESION AMOUNT

This application is based on Japanese Patent Application No. 2015-225480 filed with the Japan Patent Office on Nov. 18, 2015, the entire content of which is hereby incorporated by reference.

BACKGROUND OF THE INVENTION

Field of the Invention

This invention relates to an image forming apparatus and a control program for an image forming apparatus. More specifically, this invention relates to an image forming apparatus and a control program for an image forming apparatus, wherein the image forming apparatus includes a photo conductor drum having a cylindrical shape and a developing device.

Description of the Related Art

As electrophotography image forming apparatuses, there are an MFP (Multi Function Peripheral) with a scanner function, a facsimile function, a copying function, a function of a printer, a data transmitting function and a server function, a facsimile device, a copying machine, a printer, and so on.

Generally, an image forming apparatus develops an electrostatic latent image formed on an image supporting body, to form a toner image, transfers the toner image onto a sheet, and fixes the toner image on the sheet by using a fixing device, to form an image on the sheet. Some image forming apparatuses develop an electrostatic latent image formed on a photo conductor drum by using a developing device to form a toner image, transfer the toner image onto an intermediate transfer belt by using a primary transfer roller, and transfer second the toner image on the intermediate transfer belt to a sheet by using a secondary transfer roller. According to such the apparatuses, the photo conductor drum and the intermediate transfer belt shall be image supporting bodies.

Density of images formed on sheets by an image forming apparatus may change, due to the fatigue of an image supporting body such as a photo conductor drum with elapsed time, the temperature and humidity change around the image forming apparatus, and so on. A technique to stabilize image density is proposed. More specifically, a test patch of toner is formed on the image supporting body. The adhesion amount of the toner is detected. The developing bias is appropriately controlled, to control the adhesion amount of toner.

For example, the document 1 below discloses a technique for configuration of developing electrical potential to obtain images which have target density. Namely, a plurality of toner patch images are formed on a photo conductor drum at an arbitrary interval, based on develop electrical potential obtained by the last high density correction. The developing electrical potential is configured by the image density.

[Document 1] Japan Patent Publication No. 2011-154146

According to an electro photographic process, developing properties fluctuate along a circumferential direction of a photo conductor drum, when toner is transferred from a developing device (a developing roller) to the photo conductor drum, due to rotational unevenness of the photo conductor drum. The rotational unevenness of the photo conductor drum is caused by eccentricity of the photo conductor drum due to mechanical tolerance. According to a conventional method, density ununiformity of test patches on the image supporting body occurs, due to rotational unevenness of the photo conductor drum. The detection error of the adhesion amount of toner is large. It causes deterioration in degree of accuracy of the toner adhesion amount control. It also has a problem in which the density can not be stabilized, since the image density fluctuates each time the adhesion amount of toner was controlled.

For users, density stability among pages is an important issue which determines the quality of images. Therefore, a control system that can stabilize image density is required.

SUMMARY OF THE INVENTION

This invention is to solve the above problems. One object of this invention is to provide an image forming apparatus and a control program for an image forming apparatus which can improve accuracy of toner adhesion amount control.

Another object of this invention is to provide an image forming apparatus and a control program for an image forming apparatus which can stabilize image density.

According to one aspect of this invention, an image forming apparatus comprising: a photo conductor drum having a cylindrical shape, a developing device, a patch forming unit to form a plurality of test patches, by developing electrostatic latent images formed on a surface of the photo conductor drum with toner, by using the developing device, and a controller, wherein the controller is configured to: detect adhesion amounts of toner of the plurality of test patches formed by the patch forming unit, and calculate an approximate equation which approximates relationship between developing bias of the developing device and an adhesion amount of toner, based on developing biases of the developing device when the patch forming unit formed the plurality of test patches, and the detected adhesion amounts of toner of the plurality of test patches, wherein the distance d between an anterior end of a test patch and an anterior end of a next formed test patch is $\{(2n-1)/2\}$ times of value L, among test patches formed by the patch forming unit, where n is a natural number, and the value L is a length of the photo conductor drum in a circumferential direction, or a cycle length of fluctuation of the adhesion amount of toner which adheres to the photo conductor drum in a circumferential direction.

BRIEF DESCRIPTION OF THE DRAWINGS

FIG. 20 indicates a comparison table of the results of toner adhesion amount controls, according to the embodiments of this invention.

FIG. 22 shows dispersion of the toner amount when the toner adhesion amount control was performed multiple times, according to a comparative example, embodiment 1, and embodiment 2 of this invention.

DESCRIPTION OF THE PREFERRED EMBODIMENTS

The embodiments of this invention will be explained in the followings, based on the attached Figures.

The First Embodiment

Firstly, a structure of an image forming apparatus according to the embodiment will be explained.

Figure 1:
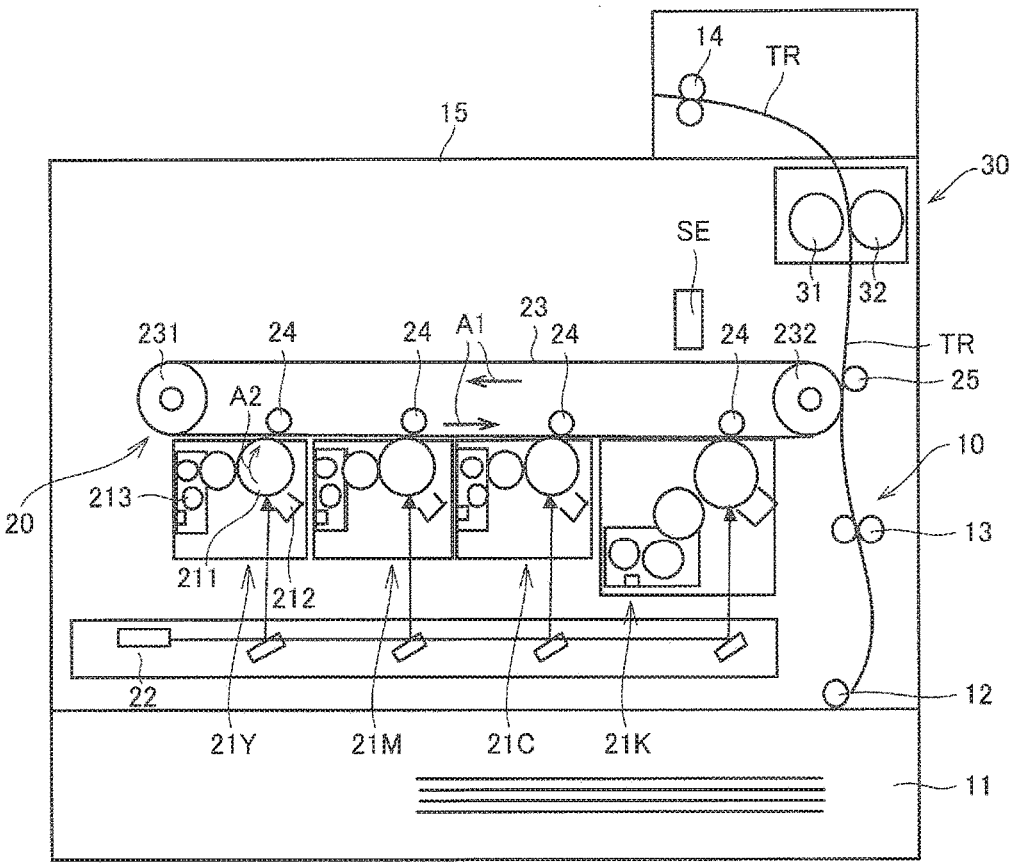
FIG. 1 shows a cross sectional view of a structure of an image forming apparatus, according to the first embodiment of this invention.

FIG. 1 shows a cross sectional view of a structure of an image forming apparatus, according to the first embodiment of this invention.

Referring to FIG. 1, the image forming apparatus according to the embodiment is an MFP. The MFP is mainly equipped with sheet conveying unit 10, toner image forming unit 20, and fixing unit 30.

Sheet conveying unit 10 includes paper feeding cartridge 11, separate unit 12, a pair of conveying rollers 13, a pair of discharge rollers 14, a copy receiving tray 15, and so on. Paper feeding cartridge 11 stores sheets on which images are to be formed. Paper feeding cartridge 11 may include a plurality of paper feeding cartridges. Separate unit 12 separates a sheet from a plurality of sheets stored in paper feeding cartridge 11, to feed the sheet of paper into conveying path TR. A pair of conveying rollers 13 conveys the sheet along with conveying path TR. A pair of discharge rollers 14 discharges the sheet on which an image was formed onto copy receiving tray 15.

Toner image forming unit 20 synthesizes images of four colors of Y (yellow), M (magenta), C (cyan), and K (black) by a so-called tandem system, and transfers the toner image onto a sheet. Toner image forming unit 20 includes four developing units 21Y, 21M, 21C and 21K (hereinafter, they may be collectively referred to as developing units 21), exposure unit 22, intermediate transfer belt 23, primary transfer rollers 24, secondary transfer roller 25, and toner adhesion amount detector SE.

Developing units 21 are parallely placed immediately below intermediate transfer belt 23. Here, developing unit 21Y which forms images of Y toner, among developing units 21Y, 21M, 21C and 21K will be explained as an example. Developing unit 21Y includes photo conductor drum 211, electrostatic charger 212, developing device 213, and so on. Electrostatic charger 212 and developing device 213 are placed around photo conductor drum 211.

Photo conductor drum 211 has a cylindrical shape, and rotates in the direction shown by arrow A2 in FIG. 1. Electrostatic charger 212 supplies electrical charge onto photo conductor drum 211, so that the surface of photo conductor drum 211 is uniformly electrostatically charged. Exposure unit 22 exposes photo conductor drum 211 which was uniformly electrostatically charged with a laser beam, based on image data of Y, which received image forming instructions. Herewith, an electrostatic latent image is formed on photo conductor drum 211. Developing device 213 attaches toner onto photo conductor drum 211. Herewith, the electrostatic latent image on photo conductor drum 211 is developed, so that a toner image is formed on photo conductor drum 211. The toner image on photo conductor drum 211 is transferred to intermediate transfer belt 23 by primary transfer roller 24. A mirror image of a toner image of four colors that will be formed on a sheet is formed on intermediate transfer belt 23.

Intermediate transfer belt 23 is in the form of a ring, and laid over rollers 231 and 232. Intermediate transfer belt 23 rotates in the direction shown by arrow A1, in conjunction with sheet conveying unit 10. A toner image on intermediate transfer belt 23 is transferred to a sheet by secondary transfer roller 25.

Secondary transfer roller 25 is placed to face a portion of intermediate transfer belt 23, which is in contact with roller 232. The distance between secondary transfer roller 25 and intermediate transfer belt 23 is adjustable by a pressure contact and separation mechanism which is not shown in the figures. A sheet is conveyed, being pinched between secondary transfer roller 25 and intermediate transfer belt 23.

Toner adhesion amount detector SE is provided at an upper part of intermediate transfer belt 23. Toner adhesion amount detector SE detects the adhesion amount of toner in test patches which were transferred to the surface of intermediate transfer belt 23.

Fixing unit 30 includes heating roller 31 and pressure roller 32. Fixing unit 30 fixes a toner image on a sheet, by conveying the sheet along with conveying path TR, holding the sheet which carries the toner image by a nip portion between heating roller 31 and pressure roller 32.

Figure 2:
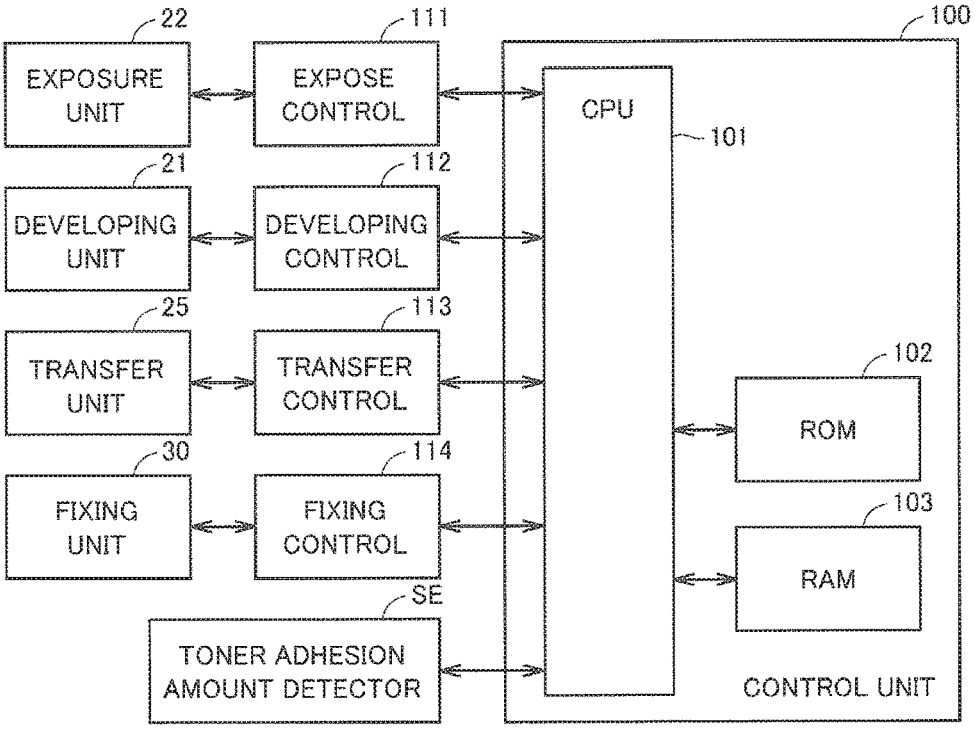
FIG. 2 shows a block diagram of a control structure of the image forming apparatus, according to the first embodiment of this invention.

FIG. 2 shows a block diagram of a control structure of the image forming apparatus, according to the first embodiment of this invention.

Referring to FIG. 2, the image forming apparatus is equipped with control unit 100, expose control unit 111, developing control unit 112, transfer control unit 113, and fixing control unit 114.

Control unit 100 includes CPU (Central Processing Unit) 101, ROM (Read Only Memory) 102, and RAM (Random Access Memory) 103. CPU 101 and each of ROM 102, RAM 103, expose control unit 111, developing control unit 112, transfer control unit 113, fixing control unit 114 and toner adhesion amount detector SE are bilaterally connected with each other.

CPU 101 controls entire behavior of the image forming apparatus. CPU 101 executes processes based on control programs.

ROM 102 stores control programs executed by CPU 101 and so on.

RAM 103 is a working memory for CPU 101 and temporarily stores data related to various jobs.

Expose control unit 111 controls behavior of exposure unit 22, such as expose light intensity, timing to irradiate each of photo conductor drums 211 with exposure light, and so on.

Developing control unit 112 controls behavior of developing unit 21, such as developing bias of developing device 213, suppliance of toner to developing device 213, rotation of an agitate roller in developing device 213, and so on.

Transfer control unit 113 controls behavior of secondary transfer roller (transfer unit) 25, such as rotation of secondary transfer roller 25, contact and separation behavior of secondary transfer roller 25, and so on.

Fixing control unit 114 controls behavior of fixing unit 30, such as temperature of heating roller 31, rotation of pressure roller 32, and so on.

The image forming apparatus performs toner adhesion amount control at predetermined timing. The toner adhesion amount control is for setting developing bias to an appropriate value, so that the aimed toner adhesion amount is achieved.

Next, a method for controlling the toner adhesion amount according to this embodiment will be explained.

Figure 3:
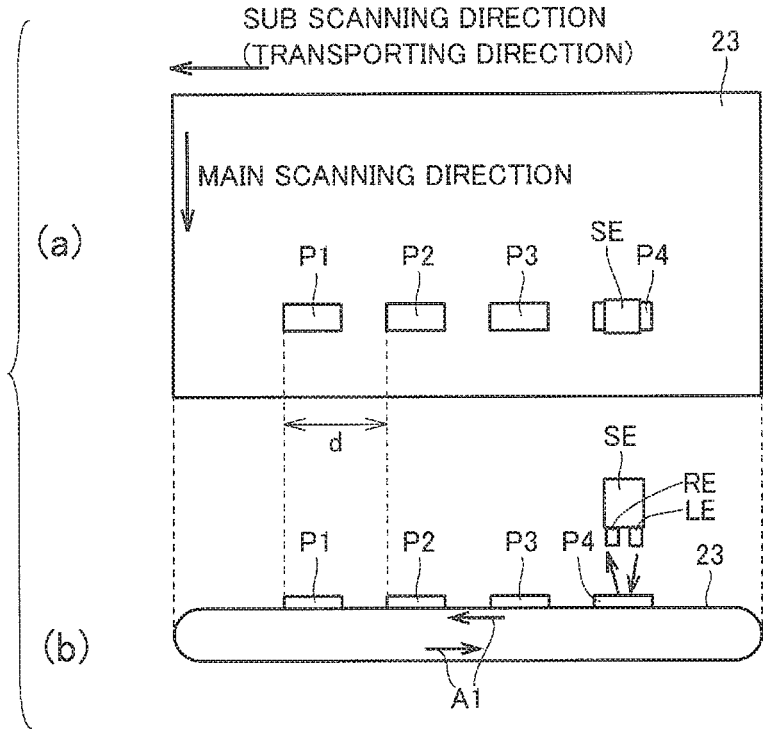
FIG. 3 schematically shows test patches arranged on intermediate transfer belt 23.

FIG. 3 schematically shows test patches arranged on intermediate transfer belt 23, according to the first embodiment of this invention. FIG. 3(*a*) shows the plan view. FIG. 3(*b*) shows the side view. FIG. 3 indicates the state in which toner adhesion amount detector SE is detecting the adhesion amount of toner in test patch P4.

Referring to FIG. 3, when the toner adhesion amount control is executed, the image forming apparatus forms a plurality (that is 4, according to this embodiment) of test patches P1, P2, P3, and P4 on intermediate transfer belt 23, in this order. Test patches P1, P2, P3, and P4 are formed by target color toner which is one of Y, M, C, and K. The plurality of test patches P1, P2, P3, and P4 are formed by developing the electrostatic latent images formed on the surface of photo conductor drum 211 with toner by using developing device 213, and transferring the developed toner image to intermediate transfer belt 23. The plurality of test patches P1, P2, P3, and P4 are aligned in the sub scanning direction. The plurality of test patches P1, P2, P3, and P4 are formed, wherein the size of each of test patches P1, P2, P3, and P4 is sufficiently larger than the aperture size of toner adhesion amount detector SE (for example, the length of each of test patches P1, P2, P3, and P4 in the main scanning direction is 10 mm, and the length of each of test patches P1, P2, P3, and P4 in the sub scanning direction is 40 mm). The plurality of test patches P1, P2, P3, and P4 are formed under the same electrostatic charging bias and the same exposure amount. The plurality of test patches P1, P2, P3, and P4 are formed under different developing biases.

Among the plurality of test patches P1, P2, P3, and P4, the interval d between the anterior end of a test patch and the anterior end of the next test patch is one-half of length L1 of photo conductor drum 211 in the circumferential direction.

Each of the plurality of test patches P1, P2, P3, and P4 is conveyed to the location which faces toner adhesion amount detector SE, in the direction shown by arrow A1, due to the rotation of intermediate transfer belt 23. Toner adhesion amount detector SE detects the adhesion amount of toner (the amount of the toner which is found in a test patch) of each of the plurality of test patches P1, P2, P3, and P4, in this order.

Toner adhesion amount detector SE includes light emitting element LE, and light reception element RE. Light emitting element LE comprises a light emitting diode and so on. Light emitting element LE obliquely irradiates the surface of intermediate transfer belt 23 with visible light or infrared light, for example. Light reception element RE comprises a photo diode and so on, for example. Light reception element RE receives reflected light from the surface of intermediate transfer belt 23. Toner adhesion amount detector SE may further include a light emitting side lens attached to light emitting element LE, a light reception side lens attached to light reception element RE, or the like. The number of test patches is arbitrary.

Figure 4:
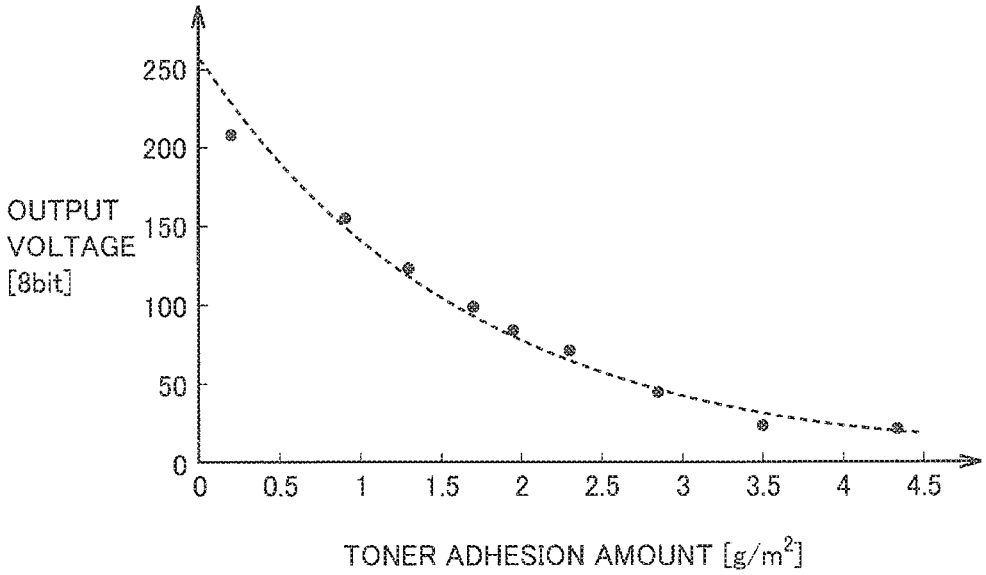
FIG. 4 indicates a table schematically showing the relationship between the toner adhesion amount and the outputting electrical voltage of toner adhesion amount detector SE.

FIG. 4 indicates a graph schematically showing the relationship between the toner adhesion amount detected by toner adhesion amount detector SE and the outputting electrical voltage of toner adhesion amount detector SE.

Referring to FIGS. 3 and 4, toner adhesion amount detector SE has characteristics in which the outputting electrical voltage decreases with increasing the adhesion amount of toner. When the amount of toner attached to the surface of the intermediate transfer belt is large, light from light emitting element LE is absorbed or diffusely reflected by the toner, so that the amount of reflected light from the surface of intermediate transfer belt 23 decreases.

The image forming apparatus calculates the average value of outputting electrical voltage sequentially output from toner adhesion amount detector SE, when detecting a test patch. The image forming apparatus converts the average value of outputting electrical voltage into the adhesion amount of toner, by using the table of FIG. 4 stored beforehand in ROM 102 or the like, to acquire the adhesion amount of toner of the test patch.

Figure 5:
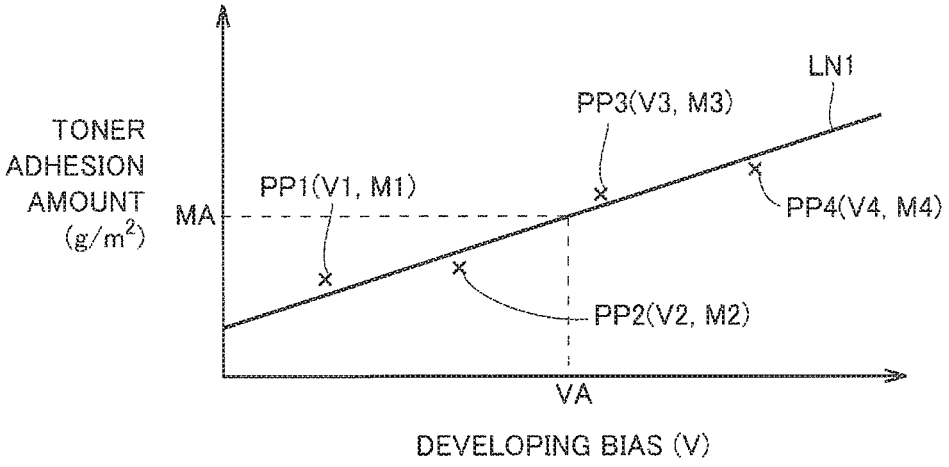
FIG. 5 indicates a graph schematically showing a calculation method for an approximate equation which approximates the relationship between developing bias of developing device 213 and the adhesion amount of toner.

FIG. 5 indicates a graph schematically showing a calculation method for an approximate equation which approximates the relationship between developing bias of developing device 213 and the adhesion amount of toner, according to the first embodiment of this invention.

Next, referring to FIG. 5, the image forming apparatus plots the developing biases and the detected adhesion amounts of toner for the plurality of test patches P1, P2, P3, and P4, in a system of coordinates of the graph, wherein the horizontal axis indicates the developing biases, and the vertical axis indicates the adhesion amounts of toner. Here, coordinate points PP1, PP2, PP3, and PP4 indicate the plurality of test patches P1, P2, P3, and P4, respectively. The developing biases of the plurality of test patches P1, P2, P3, and P4 are developing biases V1, V2, V3, and V4, respectively (V1<V2<V3<V4). The adhesion amounts of toner of the plurality of test patches P1, P2, P3, and P4 are toner adhesion amounts M1, M2, M3, and M4, respectively (M1<M2<M3<M4).

Next, the image forming apparatus calculates an approximate equation LN1 based on coordinate points PP1, PP2, PP3, and PP4, by using the method of least squares. The approximate equation LN1 approximates the relationship between developing bias of developing device 213 and the adhesion amount of toner on the surface of intermediate transfer belt 23. The approximate equation may be calculated, so that the approximate equation approximates the relationship between developing bias of developing device 213 and the adhesion amount of toner on the surface of photo conductor drum 23.

Next, the image forming apparatus identifies (calculates) developing bias VA which results in desired toner adhesion amount MA, by using the approximate equation LN1, and stores the calculation result in RAM 103 or the like. The developing bias VA is used as developing bias of the next and succeeding image formings.

The distance d between the anterior end of a test patch and the anterior end of the next test patch may be set to (2n−1) halves of length L1 of photo conductor drum 211 in the circumferential direction, where n is a natural number. In other words, distance d may be set to the value as shown by the following formula (1).

$$d=\{(2n-1)/2\}*L1 \quad (1)$$

Figure 6:
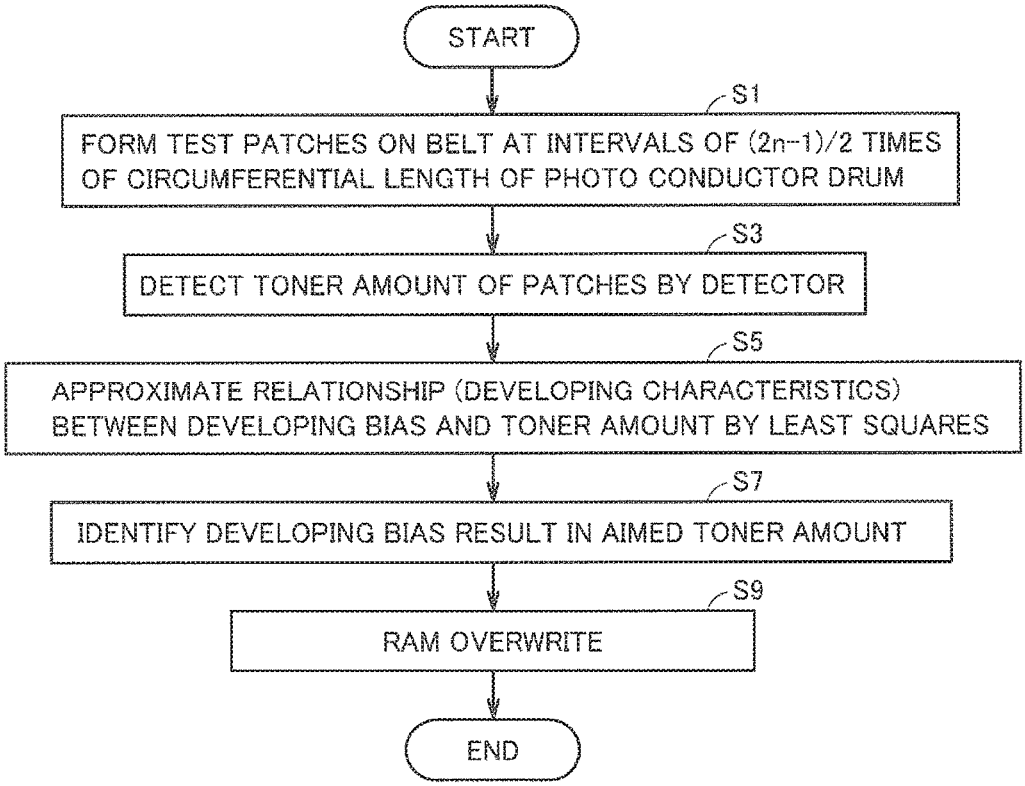
FIG. 6 shows a flowchart of behavior of the image forming apparatus when toner adhesion amount control is performed, according to the first embodiment of this invention.

FIG. 6 shows a flowchart of behavior of the image forming apparatus when toner adhesion amount control is performed, according to the first embodiment of this invention.

Referring to FIG. 6, control unit 100 of the image forming apparatus forms a plurality of test patches on intermediate transfer belt 23, at intervals of (2n−1) halves of length L1 of photo conductor drum 211 in the circumferential direction (S1). Next, control unit 100 detects the adhesion amount of toner of the plurality of test patches by toner adhesion amount detector SE (S3). Next, control unit 100 plots developing biases and adhesion amounts of toner of the plurality of test patches on a system of coordinates, and calculates an approximate equation which approximates the relationship between the developing biases and the adhesion amounts of toner, by using the method of least squares (S5). Next, control unit 100 identifies developing bias which results in the aimed adhesion amount of toner, from the approximate equation (S7). Next, control unit 100 overwrites developing bias stored in RAM 103 used by developing device 213, with the identified value of developing bias (S9), and terminates the process.

The advantages of this embodiment will be explained in the followings.

Figure 7:
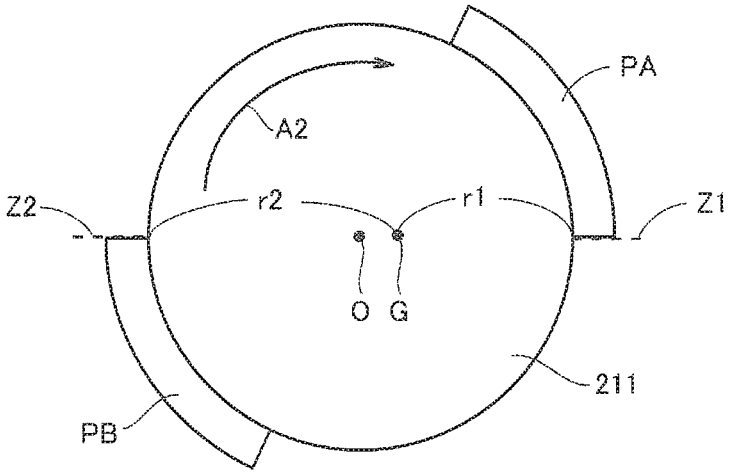
FIG. 7 is for explanation of eccentricity which may occur in photo conductor drum 211 and the harmful influence by the eccentricity.
Figure 8:
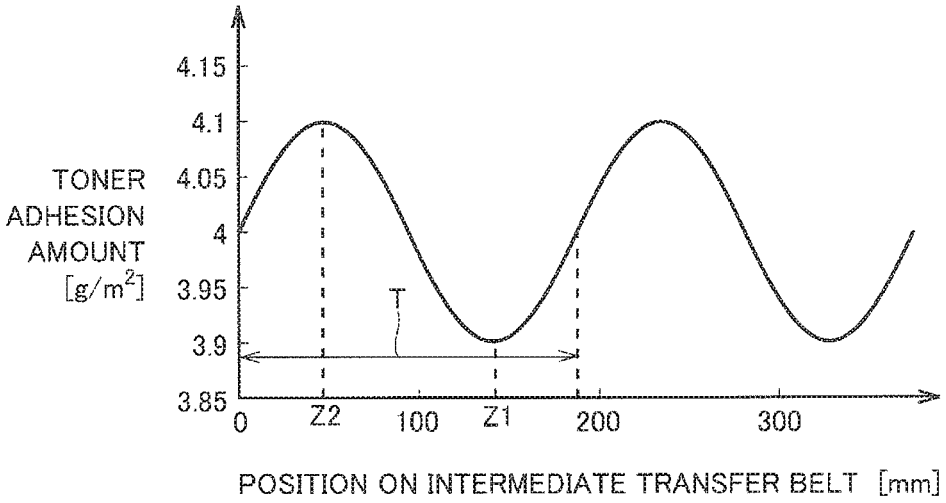
FIG. 8 indicates a graph schematically showing fluctuation of the adhesion amount of toner resulted from rotational unevenness of photo conductor drum 211.

FIG. 7 is for explanation of eccentricity which may occur in photo conductor drum 211 and the harmful influence by the eccentricity. FIG. 8 indicates a graph schematically showing fluctuation of the adhesion amount of toner resulted from rotational unevenness of photo conductor drum 211.

Referring to FIGS. 7 and 8, it is often the case that photo conductor drum 211 is eccentric due to mechanical tolerance. Actual rotational center G of photo conductor drum 211 in FIG. 7 is shifted rightward from rotational center O in appearance. When photo conductor drum 211 is eccentric, rotational unevenness occurs, and the distance (the development gap) between photo conductor drum 211 and the developing roller of developing device 213 periodically fluctuates.

Due to the fluctuation, the adhesion amount of toner in the toner image formed on intermediate transfer belt 23 fluctuates in the sub scanning direction as shown in FIG. 8. More specifically, the development gap is the maximum at the location Z1 where the distance (distance r1) from rotational center G is the minimum. At this location, the adhesion amount of toner under the same developing bias is the minimum. On the other hand, the development gap is the minimum at the location Z2 where the distance (distance r2) from rotational center G is the maximum. At this location, the adhesion amount of toner under the same developing bias is the maximum. The cycle length T of the fluctuation of the adhesion amount of toner is nearly equal to length L1 of photo conductor drum 211 in the circumferential direction (the circumference of photo conductor drum 211).

Hence, when distance d is set to one-half of length L1 of photo conductor drum 211 in the circumferential direction and the location of the anterior end of test patch PA corresponds to the location Z1, the location of the anterior end of the next test patch PB corresponds to the location Z2. The location Z2 is opposite to the location Z1, with rotational center O between them. Herewith, the effect of cancellation of the fluctuation of the adhesion amount of toner caused by the rotational unevenness of photo conductor drum 211 is produced.

Figure 9:
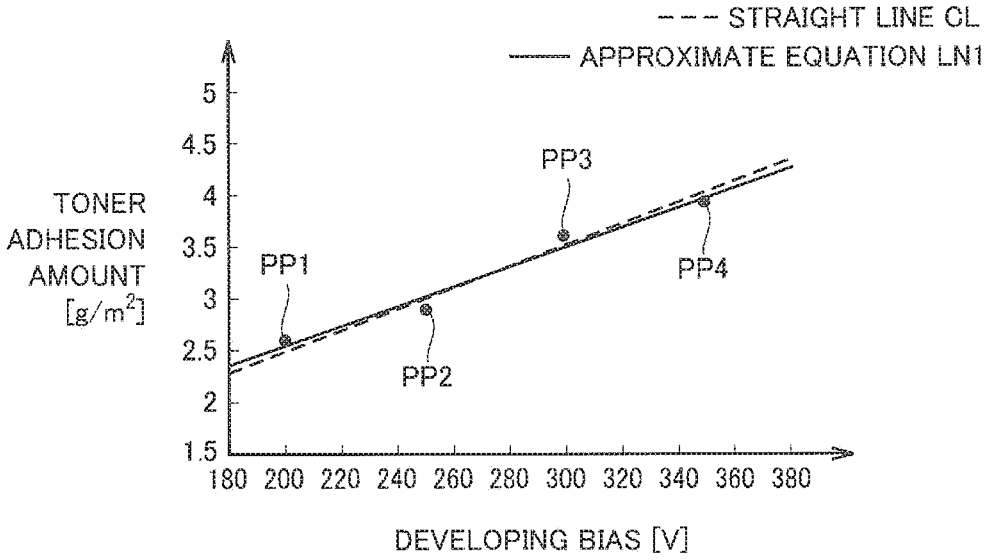
FIG. 9 indicates a graph schematically showing the relationship between approximate equation LN1 and straight line CL, wherein the straight line CL shows the center of fluctuation of the adhesion amount of toner, according to the first embodiment of this invention.

FIG. 9 indicates a graph schematically showing the relationship between approximate equation LN1 and straight line CL, wherein the straight line CL shows the center of fluctuation of the adhesion amount of toner, according to the first embodiment of this invention.

Referring to FIG. 9, coordinate points PP1 and PP3 appear at the side where the adhesion amount of toner is large, with respect to straight line CL showing the center line of actual fluctuation of the adhesion amount of toner. Coordinate points PP2 and PP4 appear at the side where the adhesion amount of toner is small. In consequence, the fluctuation of the adhesion amount of toner caused by rotational unevenness of photo conductor drum 211 is cancelled. Hence, an approximate equation LN1 which is close to straight line CL can be obtained. In consequence, accuracy of the toner adhesion amount control can be improved, so that image density can be stabilized.

The Second Embodiment

According to an image forming apparatus of this embodiment, developing bias Vi is the i-th lowest developing bias (i is the all natural numbers from 1 to (m−1)) among 4 developing biases V1, V2, V3, and V4. $M_i$ is the adhesion amount of toner corresponding to developing bias $V_i$. Coordinate point ($VM_i$, $MM_i$) which is the midpoint between coordinate point ($V_i$, $M_i$) and coordinate point ($V_{i+1}$, $M_{i+1}$) is calculated. The image forming apparatus calculates an approximate equation LN2, further based on the calculated coordinate points of the midpoints.

Figure 10:
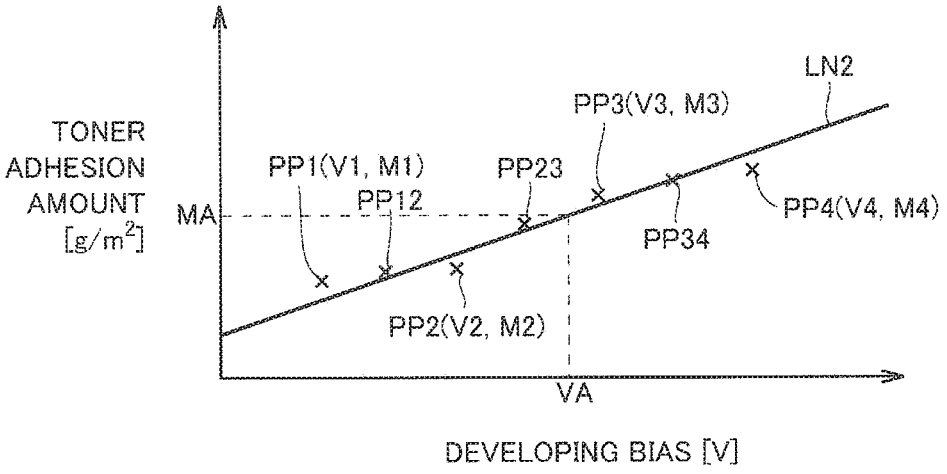
FIG. 10 indicates a graph schematically shows a calculation method for an approximate equation which approximates the relationship between developing bias of developing device 213 and the adhesion amount of toner, according to the second embodiment of this invention.

FIG. 10 indicates a graph schematically shows a calculation method for an approximate equation which approximates the relationship between developing bias of developing device 213 and the adhesion amount of toner, according to the second embodiment of this invention.

Referring to FIG. 10, the image forming apparatus acquires coordinate points PP1, PP2, PP3, and PP4 corresponding to four test patches P1, P2, P3, and P4 in a manner similar to the first embodiment. Next, the image forming apparatus calculates coordinate point PP12. Coordinate point PP12 is the midpoint between coordinate point PP1 which indicates the lowest developing bias V1 and coordinate point PP2 which indicates the second lowest developing bias V2. The image forming apparatus calculates coordinate point PP23. Coordinate point PP23 is the midpoint between coordinate point PP2 which indicates the second lowest developing bias V2 and coordinate point PP3 which indicates the third lowest developing bias V3. The image forming apparatus calculates coordinate point PP34. Coordinate point PP34 is the midpoint between coordinate point PP3 which indicates the third lowest developing bias V3 and coordinate point PP4 which indicates the fourth lowest developing bias V4. Then, the image forming apparatus calculates an approximate equation LN2, based on coordinate points PP1, PP2, PP3 and PP4, and coordinate points PP12, PP23 and PP34 which are the calculated midpoints.

Next, the image forming apparatus identifies (calculates) developing bias VA which results in desired toner adhesion amount MA, by using the approximate equation LN2, and stores the calculation result in RAM 103 or the like. The developing bias VA is used as developing bias of the next and succeeding image formings.

Figure 11:
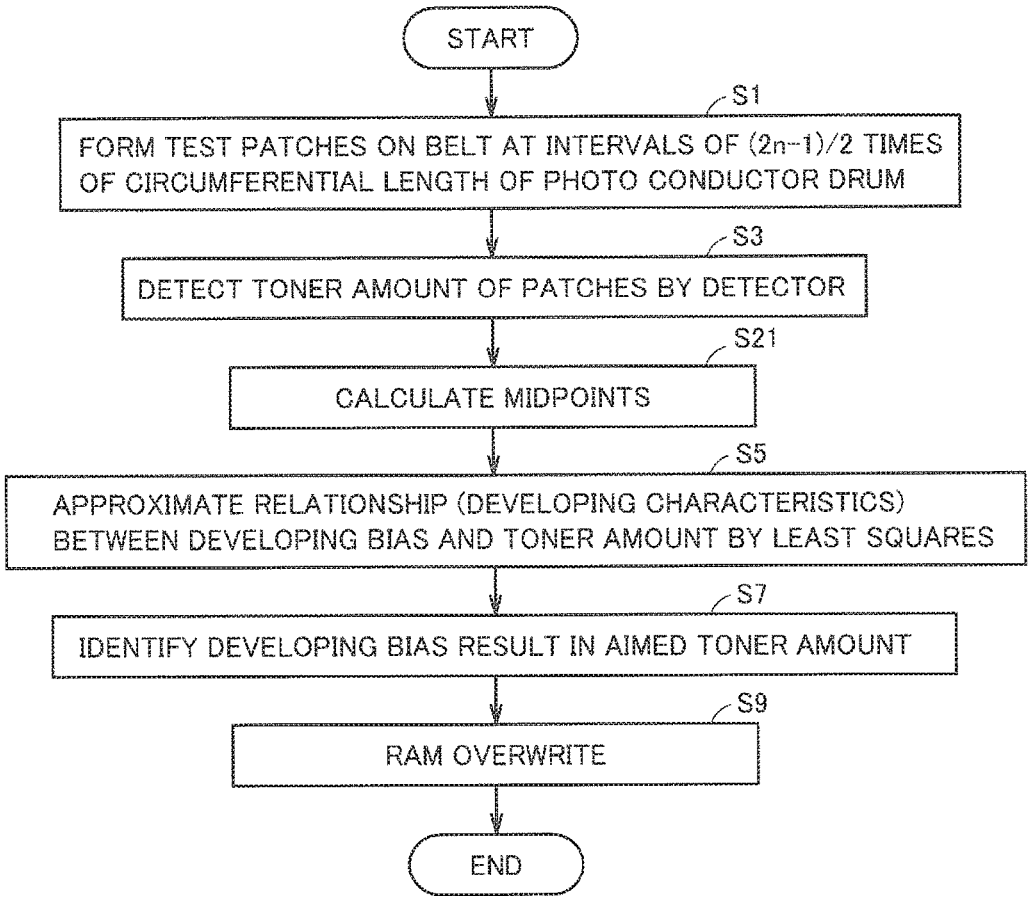
FIG. 11 shows a flowchart of behavior of the image forming apparatus when toner adhesion amount control is performed, according to the second embodiment of this invention.

FIG. 11 shows a flowchart of behavior of the image forming apparatus when toner adhesion amount control is performed, according to the second embodiment of this invention.

Referring to FIG. 11, in this flowchart, control unit 100 executes a process of step S21 between the process of step S3 and the process of step S5 shown in the flowchart of FIG. 6.

After the process of step S3, control unit 100 plots developing biases and the adhesion amounts of toner of the plurality of test patches on the system of coordinates, and calculates the midpoints of the coordinate points (S21). After that, control unit 100 steps in the process of step S5.

Since the structure and behavior of the image forming apparatus according to the embodiment other than the above mentioned are similar to the first embodiment, the explanation is not repeated.

This embodiment has effect similar to the first embodiment. In addition, by calculating an approximate equation further using the coordinate midpoints, the accuracy of the approximate equation can be improved, and the adhesion amount of toner becomes more suitable.

The Third Embodiment

According to this embodiment, the image forming apparatus forms two or more test patches by using at least one developing bias among a plurality of developing biases. The average value of the adhesion amounts of toner of the two or more test patches is regarded as the adhesion amount of toner corresponding to the above mentioned at least one developing bias.

Figure 12:
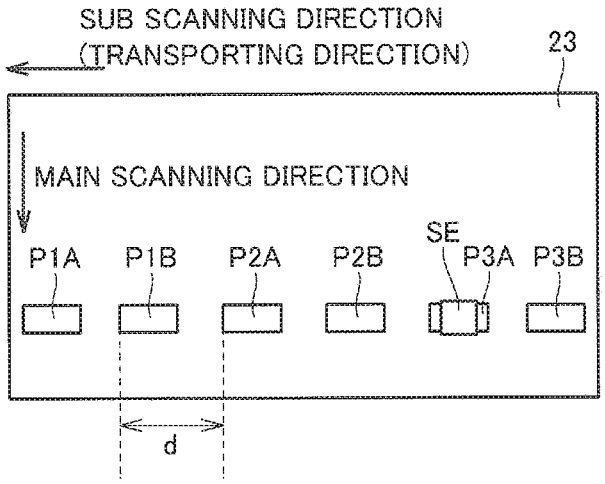
FIG. 12 schematically shows test patches arranged on intermediate transfer belt 23, according to the third embodiment of this invention.

FIG. 12 indicates a plan view schematically showing test patches arranged on intermediate transfer belt 23, according to the third embodiment of this invention.

Referring to FIG. 12, the image forming apparatus forms a plurality of test patches P1A, P1B, P2A, P2B, P3A, and P3B at an interval of d, and detects each of the adhesion amounts of toner of the plurality of test patches P1A, P1B, P2A, P2B, P3A, and P3B by using toner adhesion amount detector SE. The developing bias for test patches P1A and P1B is V1 (=200V). The developing bias for test patches P2A and P2B is V2 (=280V). The developing bias for test patches P3A and P3B is V3 (=350V).

Figure 13:
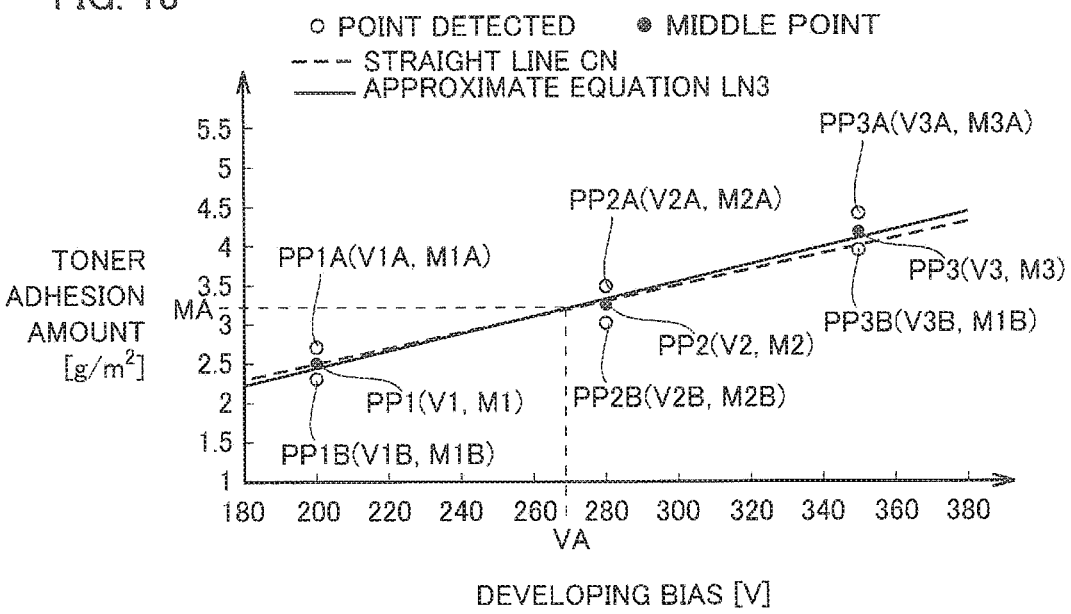
FIG. 13 indicates a graph schematically shows a calculation method for an approximate equation which approximates the relationship between developing bias of developing device 213 and the adhesion amount of toner, according to the third embodiment of this invention.

FIG. 13 indicates a graph schematically shows a calculation method for an approximate equation which approximates the relationship between developing bias of developing device 213 and the adhesion amount of toner, according to the third embodiment of this invention.

Referring to FIG. 13, the image forming apparatus plots developing biases and the adhesion amounts of toner of the plurality of test patches P1A, P1B, P2A, P2B, P3A, and P3B on the system of coordinates. Here, coordinate points for the plurality of test patches P1A, P1B, P2A, P2B, P3A, and P3B are plotted as coordinate points PP1A, PP1B, PP2A, PP2B, PP3A, and PP3B, respectively. The adhesion amounts of toner of the plurality of test patches P1A and P1B detected by toner adhesion amount detector SE shall be toner adhesion amounts M1A and M1B. The adhesion amounts of toner of the plurality of test patches P2A and P2B detected by toner adhesion amount detector SE shall be toner adhesion amounts M2A and M2B. The adhesion amounts of toner of the plurality of test patches P3A and P3B detected by toner adhesion amount detector SE shall be toner adhesion amounts M3A and M3B.

Next, the image forming apparatus calculates the average value of the adhesion amounts of toner of test patches P1A and P1B formed by the same developing bias. The image forming apparatus regards the adhesion amount of toner M1 corresponding to developing bias V1 as the calculated average value, and plots coordinate point PP1 (V1, M1). Similarly, the image forming apparatus calculates the average value of the adhesion amounts of toner of test patches P2A and P2B. The image forming apparatus regards the adhesion amount of toner M2 corresponding to developing bias V2 as the calculated average value, and plots coordinate point PP2 (V2, M2). Similarly, the image forming apparatus calculates the average value of the adhesion amounts of toner of test patches P3A and P3B. The image forming apparatus regards the adhesion amount of toner M3 corresponding to developing bias V3 as the calculated average value, and plots coordinate point PP3 (V3, M3).

Next, the image forming apparatus calculates an approximate equation LN3 which approximates the relationship between developing bias of developing device 213 and the adhesion amount of toner, by using the method of least squares, based on coordinate points PP1, PP2, and PP3.

The image forming apparatus may calculate coordinate point PP12 which is the midpoint between coordinate point PP1 and coordinate point PP2, and coordinate point PP23 which is the midpoint between coordinate point PP2 and coordinate point PP3. The image forming apparatus may calculate the approximate equation LN3, further based on coordinate points PP12 and PP23.

Next, the image forming apparatus identifies (calculates) developing bias VA which results in desired toner adhesion amount MA, by using the approximate equation LN3, and stores the calculation result in RAM 103 or the like. The developing bias VA is used as developing bias of the next and succeeding image formings.

Figure 14:
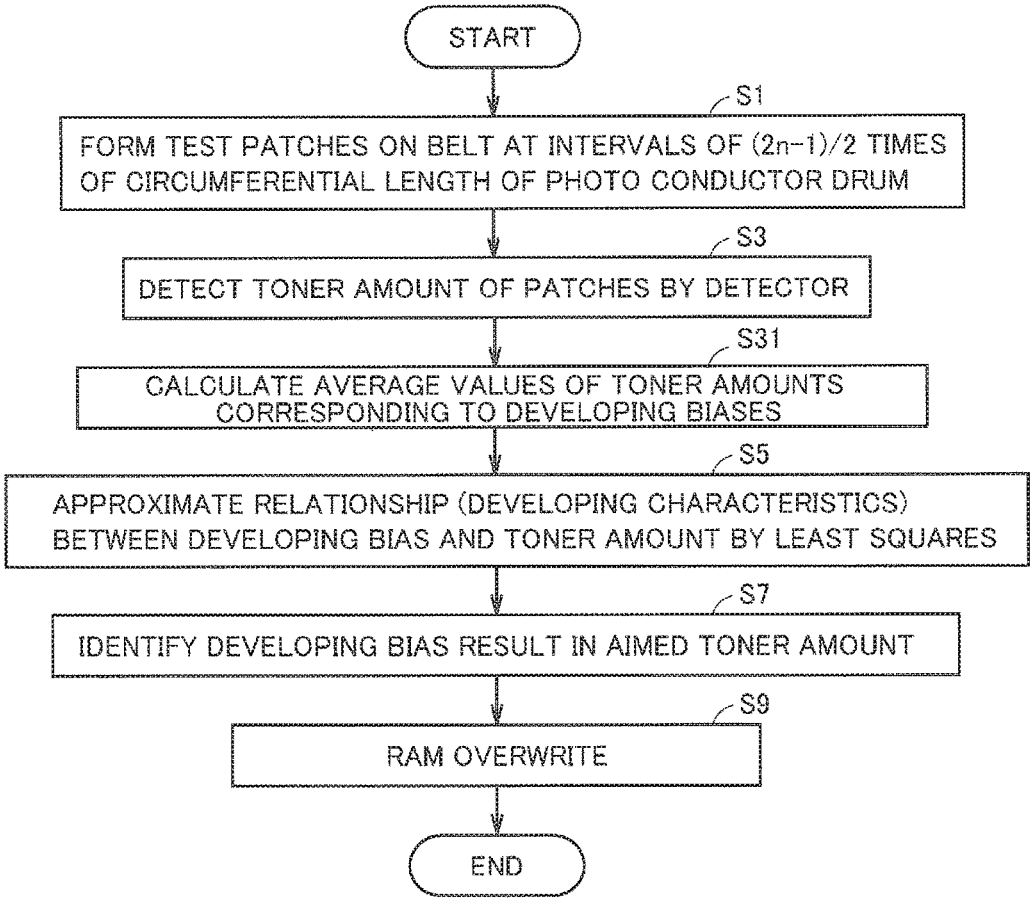
FIG. 14 shows a flowchart of behavior of the image forming apparatus when toner adhesion amount control is performed, according to the third embodiment of this invention.

FIG. 14 shows a flowchart of behavior of the image forming apparatus when toner adhesion amount control is performed, according to the third embodiment of this invention.

Referring to FIG. 14, in this flowchart, control unit 100 executes a process of step S31 between the process of step S3 and the process of step S5 shown in the flowchart of FIG. 6.

After the process of step S3, control unit 100 plots developing biases and the adhesion amounts of toner of the plurality of test patches in the system of coordinates. Control unit 100 also calculates the average values of the adhesion amounts of toner corresponding to developing biases, and plots them in the system of coordinates (S31). Next, control unit 100 calculates an approximate equation which approximates the relationship between the developing bias and the adhesion amount of toner by using the method of least squares, based on coordinate points of the developing biases and the average values of the adhesion amounts of toner (S5), and steps in the process of step S7.

Since the structure and behavior of the image forming apparatus according to the embodiment other than the above mentioned are similar to the first embodiment, the explanation is not repeated.

This embodiment has effect similar to the first embodiment. In addition, by calculating an approximate equation using the average value of the adhesion amounts of toner at a developing bias, the accuracy of the approximate equation can be improved, and the adhesion amount of toner becomes more suitable.

The Fourth Embodiment

According to this embodiment, an image forming apparatus calculates cycle length L2 of the adhesion amount of toner which adheres to a photo conductor drum, in the circumferential direction, and sets the distance d between the anterior end of a test patch and the anterior end of the next test patch among a plurality of test patches to one-half of the calculated cycle length L2.

When toner adhesion amount control is performed, the image forming apparatus firstly forms a belt-like toner image for detecting the adhesion amount fluctuation cycle on intermediate transfer belt 23. The image forming apparatus detects the adhesion amount of toner in the belt-like toner image, by using toner adhesion amount detector SE. The belt-like toner should have a length in the sub scanning direction sufficient to extend the whole circumference of photo conductor drum 211 (the circumference of photo conductor drum 211).

Figure 15:
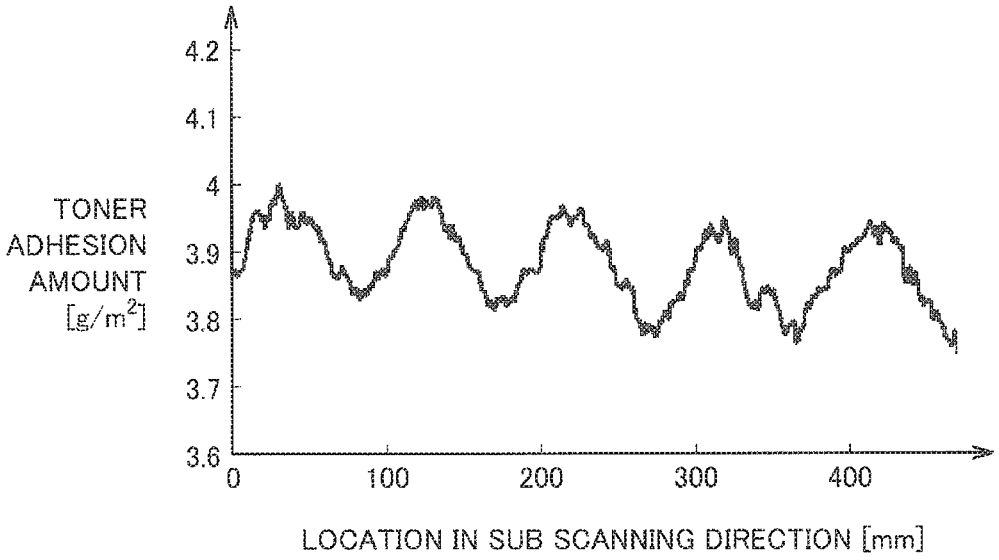
FIG. 15 indicates a graph schematically showing distribution of the adhesion amount of toner in the sub scanning direction of a belt-like toner image detected by toner adhesion amount detector SE, according to the fourth embodiment of this invention.

FIG. 15 indicates a graph schematically showing distribution of the adhesion amount of toner in the sub scanning direction of a belt-like toner image detected by toner adhesion amount detector SE, according to the fourth embodiment of this invention.

Referring to FIG. 15, periodical fluctuation of the adhesion amount of toner in the sub scanning direction occurs, in the belt-like toner image formed on intermediate transfer belt 23. The image forming apparatus performs a FFT (Fast Fourier Transform) analysis with respect to the distribution of the adhesion amount of toner in the sub scanning direction as shown in FIG. 15.

Figure 16:
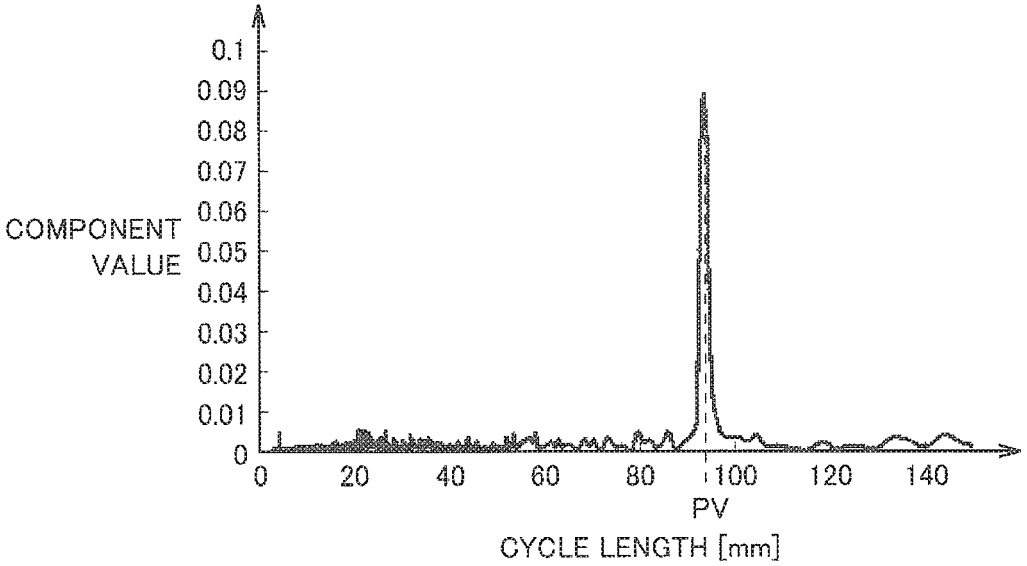
FIG. 16 indicates a graph showing the result of FFT analysis of the distribution of the adhesion amount of toner in the sub scanning direction shown in FIG. 15.

FIG. 16 indicates a graph showing the result of the FFT analysis of the distribution of the adhesion amount of toner in the sub scanning direction shown in FIG. 15. The vertical axis in FIG. 16 indicates the component value calculated by the FFT analysis. The horizontal axis indicates the cycle length.

Referring to FIG. 16, in case that there is periodical fluctuation of the adhesion amount of toner in the belt-like toner image in the sub scanning direction as shown in FIG. 15, the largest peak value PV appears at the location of the most significant cycle length in the fluctuation, according to the result of the FFT analysis. According to FIG. 16, the peak value PV is at 93 mm. According to the result of this FFT analysis, control unit 100 regards the most significant cycle length L2 of component values of cycle lengths as 93 mm. Control unit 100 records the cycle length L2 as the adhesion amount fluctuation cycle, in RAM 103.

Next, the image forming apparatus forms a plurality of test patches on intermediate transfer belt 23, and detects the adhesion amounts of toner of the plurality of test patches by toner adhesion amount detector SE. Among the plurality of test patches P1, P2, P3, and P4, the distance d between the anterior end of a test patch and the anterior end of the next test patch is one-half of cycle length L2 of fluctuation of the adhesion amount of toner in the belt-like toner image in the sub scanning direction.

After that, the image forming apparatus calculates an approximate equation in a manner similar to the first embodiment, and identifies (calculates) developing bias VA which results in the desired the toner adhesion amount MA by using the calculated approximate equation. The image forming apparatus stores the developing bias VA in RAM 103 or the like.

The distance d between the anterior end of a test patch and the anterior end of the next test patch may be set to (2n−1) halves of cycle length L2 of the fluctuation of the adhesion amount of toner in the belt-like toner image in the sub scanning direction. In other words, distance d may be configured by the following expression (2), where n is the natural number.

$$d=\{(2n-1)/2\}*L2 \quad (2)$$

Figure 17:
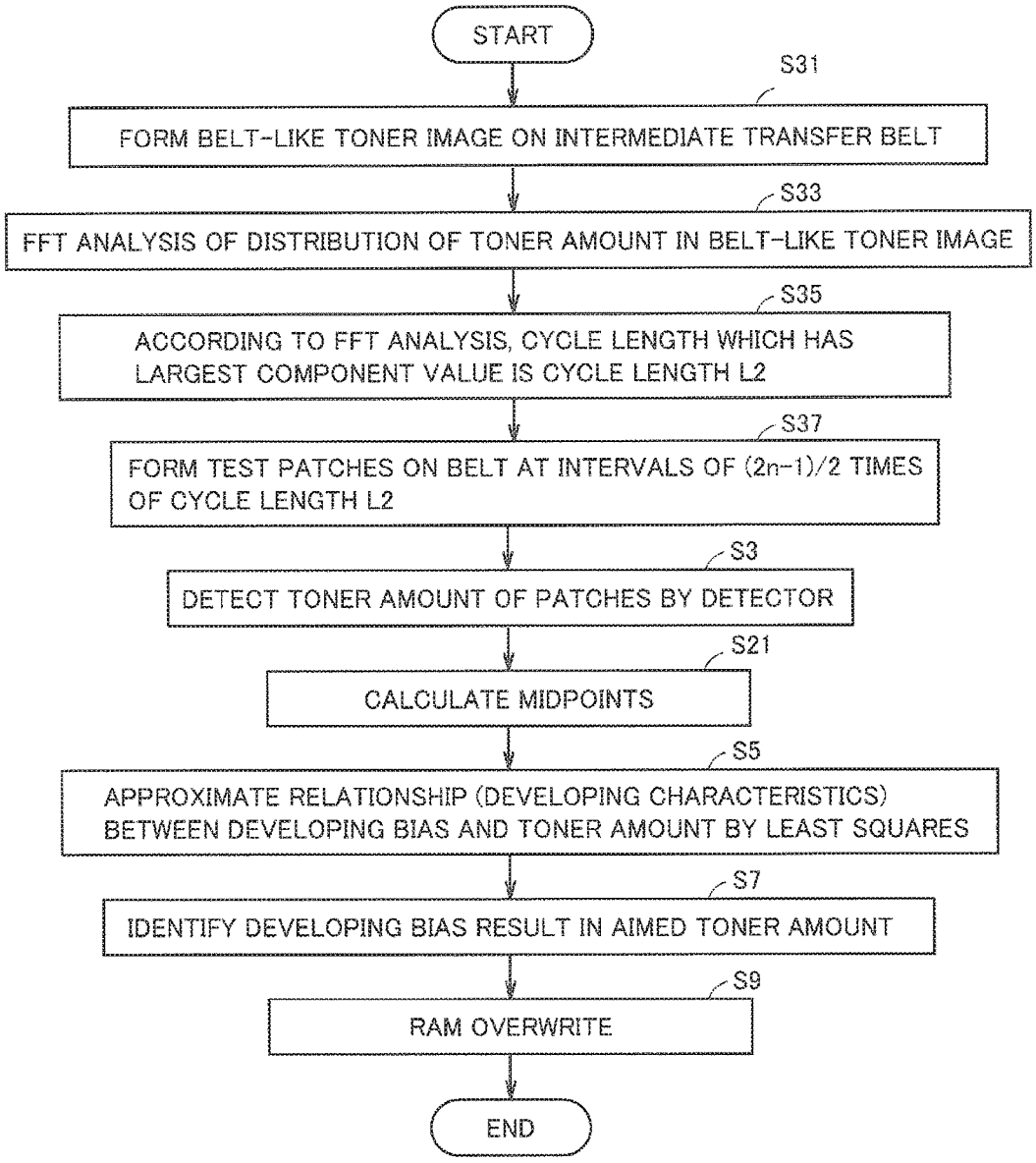
FIG. 17 shows a flowchart of behavior of the image forming apparatus when toner adhesion amount control is performed, according to the fourth embodiment of this invention.

FIG. 17 shows a flowchart of behavior of the image forming apparatus when toner adhesion amount control is performed, according to the fourth embodiment of this invention.

Referring to FIG. 17, in this flowchart, control unit 100 executes processes of steps S31, S33, S35, and S37, as substitute for the process of step S1 in FIG. 11.

At step S31, control unit 100 forms the belt-like toner image on intermediate transfer belt 23, and detects the adhesion amount of toner of the belt-like toner image, by using toner adhesion amount detector SE (S31). Next, control unit 100 executes an FFT analysis with respect to the distribution of the adhesion amount of toner in the belt-like toner image (S33). Control unit 100 regards the cycle length which has the largest component value in the FFT analysis result, as the cycle length L2 of fluctuation of the adhesion amount of toner in the belt-like toner image in the sub scanning direction (S35). Next, control unit 100 forms a plurality of test patches on intermediate transfer belt 23, at intervals of (2n−1) halves of cycle length L2 (S37). After that, control unit 100 steps in the process of step S3.

Since the structure and behavior of the image forming apparatus according to the embodiment other than the above mentioned are similar to the first embodiment, the explanation is not repeated.

As explained in the first embodiment, the fluctuation of the adhesion amount of toner in the sub scanning direction is due to eccentricity of photo conductor drum 211. In addition, fluctuation of the adhesion amount of toner in the sub scanning direction is caused by rotational unevenness of the other rotating bodies, such as developing rollers in developing device 213 and intermediate transfer belt 23. According to the embodiment, the distance d between test patches can be set to a value further taking into account influence of rotational unevenness of rotating bodies other than photo conductor drum 211, by measuring fluctuation the adhesion amount of toner in the sub scanning direction of the belt-like toner image. In consequence, the accuracy of the approximate equation can be improved, and the adhesion amount of toner becomes more suitable.

The Fifth Embodiment

According to this embodiment, an image forming apparatus detects the adhesion amount of toner of test patches formed on the surface of photo conductor drum 211.

Figure 18:
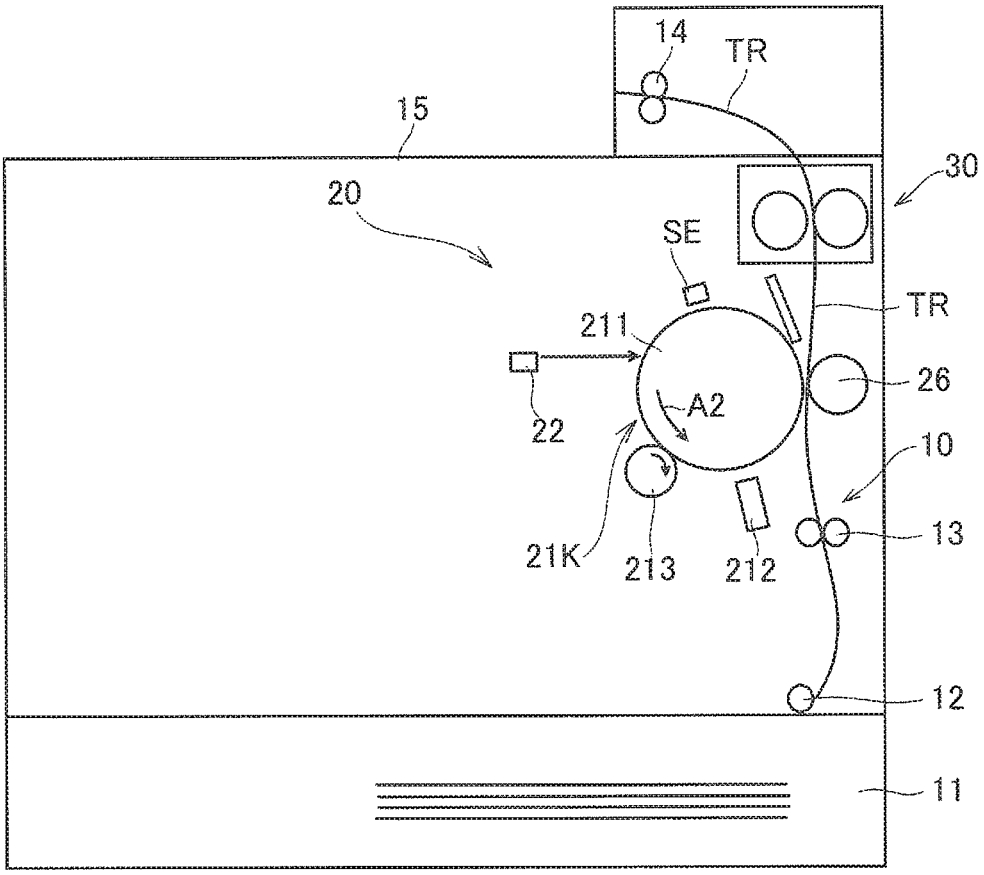
FIG. 18 shows a cross sectional view of a structure of an image forming apparatus, according to the fifth embodiment of this invention.

FIG. 18 shows a cross sectional view of a structure of the image forming apparatus, according to the fifth embodiment of this invention.

Referring to FIG. 18, the image forming apparatus according to the embodiment is a black-and-white printer. The structure of the toner image forming unit 20 differs from the image forming apparatus of the first embodiment.

Toner image forming unit 20 includes developing unit 21K for K, exposure unit 22, transfer roller 26, and toner adhesion amount detector SE.

Photo conductor drum 211 rotates in the direction shown by arrow A2 in FIG. 18. Electrostatic charger 212 supplies electrical charge on photo conductor drum 211, so that the surface of photo conductor drum 211 is uniformly electrostatic charged. Exposure unit 22 exposes photo conductor drum 211 which was uniformly electrostatic charged with a laser beam, based on image data with instructions of image forming. Herewith, an electrostatic latent image is formed on photo conductor drum 211. Developing device 213 attaches toner onto photo conductor drum 211. Herewith, the electrostatic latent image on photo conductor drum 211 is developed, so that a toner image is formed on photo conductor drum 211. The toner image on photo conductor drum 211 is transferred to a sheet by transfer roller 26.

Toner adhesion amount detector SE is installed near photo conductor drum 211. Toner adhesion amount detector SE detects the adhesion amounts of toner of test patches formed on the surface of photo conductor drum 211. The image forming apparatus calculates an approximate equation which approximates the relationship between developing bias of developing device 213 and the adhesion amount of toner on the surface of photo conductor drum 23, by using the method of least squares, based on the detected adhesion amounts of toner.

Since the structure and behavior of the image forming apparatus according to the embodiment other than the above mentioned are similar to the first embodiment, the explanation is not repeated.

According to this embodiment, this invention is applicable to a structure which detects the adhesion amount of toner of test patches formed on the surface of photo conductor drum 211.

EMBODIMENTS

The inventor of this patent application performed the following experiments, to confirm the efficacy of the first and the second embodiments.

Figure 19:
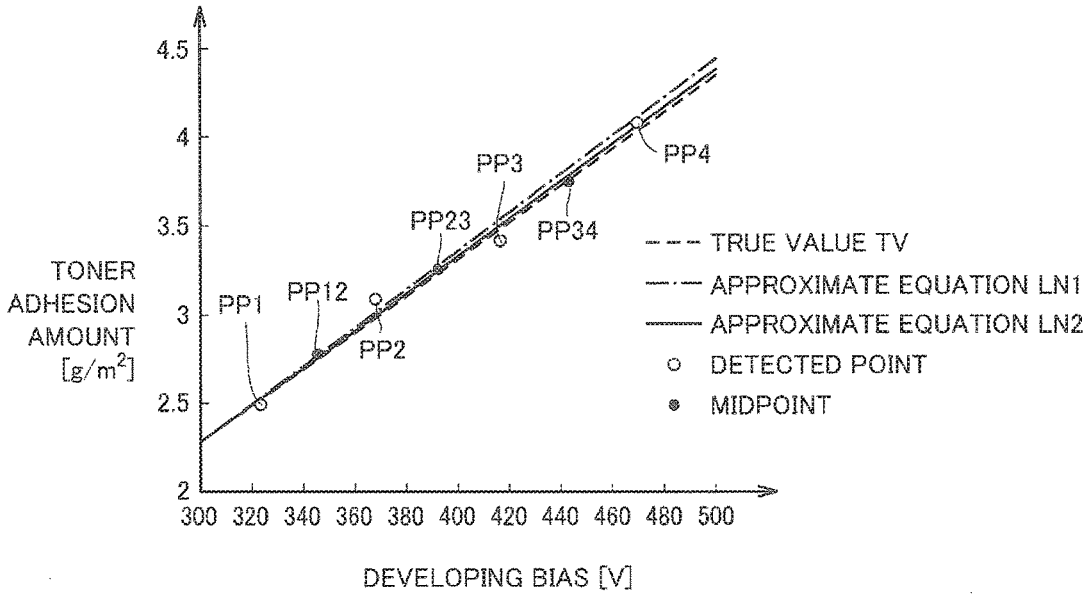
FIG. 19 indicates a graph showing approximate equations LN1 and LN2 calculated by the embodiments of this invention.

FIG. 19 indicates a graph showing approximate equations LN1 and LN2 calculated by the embodiments of this invention.

Referring to FIG. 19, four test patches P1, P2, P3, and P4 were firstly formed on the intermediate transfer belt, at developing biases of 325V, 365V, 415V and 470V, respectively. The adhesion amounts of toner of the four test patches were measured by using the toner adhesion amount detector. Next, coordinate points of developing biases and the adhesion amounts of toner for the four test patches were plotted in the system of coordinates. The approximate equation LN1 which indicates the relationship between the developing bias and the adhesion amount of toner was calculated, based on the four coordinate points PP1, PP2, PP3 and PP4 corresponding to the four test patches. The approximate equation LN1 was calculated by using the method of the first embodiment (hereinafter, it may be referred to as embodiment 1). Next, the midpoints of four coordinate points PP1, PP2, PP3 and PP4 corresponding to the four test patches P1, P2, P3 and P4 were calculated. Next, the approximate equation LN2 which indicates the relationship between developing bias and the adhesion amount of toner was calculated, based on the four coordinate points PP1, PP2, PP3 and PP4 corresponding to the four test patches and the calculated midpoints which are coordinate points PP12, PP23 and PP34. The approximate equation LN2 is calculated by using the method of the second embodiment (hereinafter, it may be referred to as embodiment 2).

True values TV shows the developing characteristics acquired by actual toner measurement when performing the control. The approximate equation LN1 in embodiment 1 is close to the true values TV. The approximate equation LN2 in embodiment 2 is closer to the true values TV, than approximate equation LN1.

Next, the developing biases when the aimed toner adhesion amount is 4 g/m$^2$ were identified by using approximate equations LN1 and LN2. Then, toner images were formed at the identified developing biases. The adhesion amounts of toner of the formed toner images were measured.

As a comparative example, an approximate equation was calculated in accordance with the method disclosed in the above mentioned Document 1. The developing bias when the aimed toner adhesion amount is 4 g/m$^2$ was identified. Then a toner image was formed at the identified developing bias. The adhesion amount of toner of the formed toner image was measured.

FIG. 20 indicates a comparison table of the results of toner adhesion amount controls, according to the embodiments of this invention.

Referring to FIG. 20, by the comparative example, the developing bias is 459V when the aimed toner adhesion amount is 4 g/m$^2$, the adhesion amount of toner of the toner image is 3.9 g/m$^2$, and the shift from the aimed toner adhesion amount is large. On the other hand, by using the approximate equation LN1 (in the embodiment 1), the developing bias is 464V when the aimed toner adhesion amount is 4 g/m2, the adhesion amount of toner of the toner image is 3.95 g/m$^2$, and the shift from the aimed toner adhesion amount is smaller than the comparative example. By using the approximate equation LN2 (in the embodiment 2), the developing bias is 465V when the aimed toner adhesion amount is 4 g/m$^2$, the adhesion amount of toner of the toner image is 3.96 g/m$^2$, the shift from the aimed toner adhesion amount is further smaller than the case of approximate equation LN1.

Next, the inventor of this patent application tried multiple times the toner adhesion amount controls of the comparative example, the embodiment 1 and the embodiment 2. Toner images were formed each time under the configured developing biases. The dispersion (6σ) of the adhesion amounts of toner in the formed toner images were evaluated.

Figure 21:
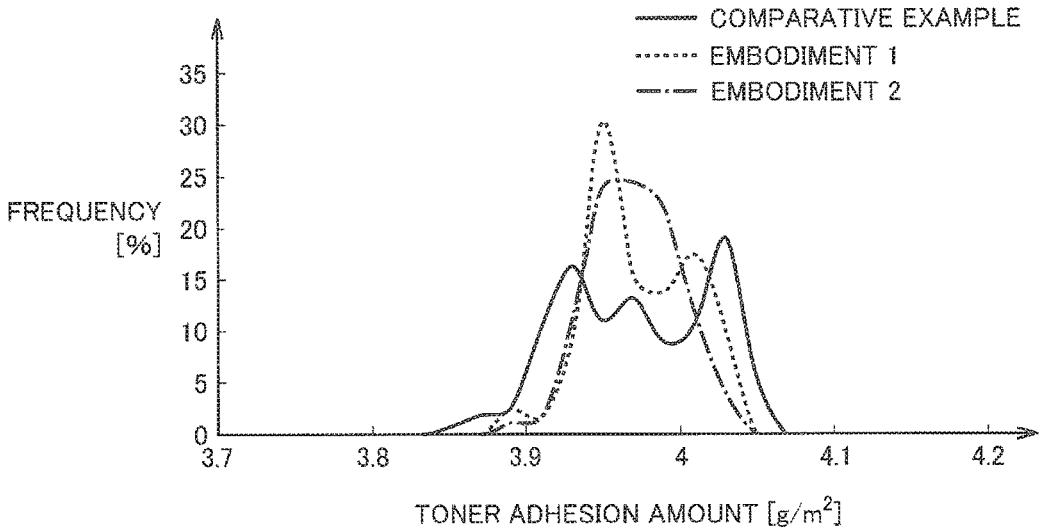
FIG. 21 shows distribution of the toner amount when the toner adhesion amount control was performed multiple times, according to a comparative example, embodiment 1, and embodiment 2 of this invention.

FIG. 21 shows distribution of the toner amount when the toner adhesion amount control was performed multiple times, according to the comparative example, embodiment 1, and embodiment 2 of this invention. FIG. 22 shows dispersion of the toner amount when the toner adhesion amount control was performed multiple times, according to the comparative example, embodiment 1, and embodiment 2 of this invention. The repetition dispersion (6σ) in FIG. 22 indicates the width of the range from +6σ to −6σ of the distribution of the toner amount.

Referring to FIGS. 21 and 22, as compared by the repetition dispersion (6σ), the repetition dispersion of the comparative example is 0.29 $g/m^2$. On the other hand, the repetition dispersion of embodiment 1 is 0.2 $g/m^2$. When the toner adhesion amount control was performed multiple times, the fluctuation of the toner amount in embodiment 1 is smaller than that of the comparative example, so that the image density can be stabilized. Further, the repetition dispersion of embodiment 2 is 0.17 $g/m^2$. When the toner adhesion amount control was performed multiple times, the fluctuation of the toner amount in embodiment 2 is smaller than that of embodiment 1, so that the image density can be further stabilized.

[Others]

The image forming apparatus of this invention may be an MFP, a black-and-white a printer, a color printer, a copying machine, a facsimile, or the like.

The above mentioned embodiments can be appropriately combined. For example, the structure for detecting the adhesion amount of toner of test patches formed on the surface of a photo conductor drum in the fifth embodiment can be combined to each of the first to the fourth embodiments.

The processes in the above mentioned embodiments can be performed by software and a hardware circuit. A computer program which executes the processes in the above embodiments can be provided. The program may be provided recorded in recording media of CD-ROMs, flexible disks, hard disks, ROMs, RAMs, memory cards, or the like to users. The program is executed by a computer of a CPU or the like. The program may be downloaded to a device via communication lines like the internet. The processes explained in the above flowcharts and the description are executed by a CPU in line with the program.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a photoconductor drum having a cylindrical shape, a developing device, a patch forming unit to form a plurality of test patches of a same color, by developing electrostatic latent images formed on a surface of the photoconductor drum with toner, by using the developing device, the plurality of test patches being formed under m developing biases, which are different from each other, a controller, wherein the controller is configured to:

detect adhesion amounts of toner of the plurality of test patches formed by the patch forming unit, and calculate an approximate equation which approximates relationship between developing bias of the developing device and an adhesion amount of toner, based on coordinate points configured with the m developing biases of the developing device when the patch forming unit formed the plurality of test patches, and the detected adhesion amounts of toner of the plurality of test patches corresponding to the m developing biases, wherein distance d between an anterior end of a test patch and an anterior end of a next formed test patch is {(2n−1)/2} times of value L, among test patches formed by the patch forming unit, where n is a natural number and the value L is a length of the photoconductor drum in a circumferential direction, or a cycle length of fluctuation of the adhesion amount of toner which adheres to the photoconductor drum in a circumferential direction, and a controlling means to calculate a value of the developing bias corresponding to a target adhesion amount by using the calculated approximate equation, and form an image by using the calculated value of the developing bias.

2. The image forming apparatus according to claim 1, wherein the controller calculates the approximate equation by using a method of least squares.

3. The image forming apparatus according to claim 1, wherein the controller is further configured to calculate a coordinate point which is a midpoint between a coordinate point ($V_i$, $M_i$) and a coordinate points ($V_{i+1}$, $M_{i+1}$), where Vi indicates the i-th lowest developing bias (i is a natural number from 1 to (m−1)) among the m developing biases, and Mi indicates the adhesion amount of toner corresponding to Vi, and calculate the approximate equation, further based on the calculated midpoint coordinate point.

4. The image forming apparatus according to claim 1, wherein the patch forming unit forms two or more test patches with at least one of the m developing biases, the controller is further configured to determine an average value of the adhesion amounts of toner of the two or more test patches detected, and use the average value as the adhesion amount of toner corresponding to at least one of the developing biases when calculating the approximate equation.

5. The image forming apparatus according to claim 1, further comprising:

a toner image forming unit to form a toner image which extends whole circumference of the photoconductor drum, on a surface of the photoconductor drum, and a toner amount detecting unit to detect distribution of the adhesion amount of toner of the toner image formed by the toner image forming unit, in a circumferential direction of the drum, the distribution including a periodic fluctuation, wherein the controller is further configured to calculate a cycle length of the periodic fluctuation of the adhesion amount of toner adhered to the photoconductor drum in the circumferential direction, based on the distribution detected by the toner amount detecting unit.

6. The image forming apparatus according to claim 1, further comprising:

an intermediate transfer belt, wherein the controller detects the adhesion amounts of toner for the plurality of test patches transferred from the photoconductor drum to a surface of the intermediate transfer belt.

7. The image forming apparatus according to claim 1, wherein:

the controller detects the adhesion amount of toner for the plurality of test patches formed on a surface of the photoconductor drum.

8. A non-transitory computer-readable recording medium storing a controlling program for an image forming device, wherein the image forming device comprising:

a photoconductor drum having a cylindrical shape, a developing device, a patch forming unit to form a plurality of test patches of a same color, by developing electrostatic latent images formed on a surface of the photoconductor drum with toner, by using the developing device, the plurality of test patches being formed under m developing biases, which are different from each other, wherein the controlling program causes a computer to execute the steps of:

detect adhesion amounts of toner of the plurality of test patches formed by the patch forming unit, and calculate an approximate equation which approximates relationship between developing bias of the developing device and an adhesion amount of toner, based on coordinate points configured with the m developing biases of the developing device when the patch forming unit formed the plurality of test patches and the detected adhesion amounts of toner of the plurality of test patches corresponding to the m developing biases, wherein distance d between an anterior end of a test patch and an anterior end of a next formed test patch is $\{(2n-1)/2\}$ times of value L, among test patches formed by the patch forming unit, where n is a natural number, and the value L is a length of the photoconductor drum in a circumferential direction, or a cycle length of fluctuation of the adhesion amount of toner which adheres to the photoconductor drum in a circumferential direction, and a controlling means to calculate a value of the developing bias corresponding to a target adhesion amount by using the calculated approximate equation, and form an image by using the calculated value of the developing bias.

9. The non-transitory computer-readable recording medium according to claim 8, wherein the controlling program causes a computer to execute the step of:

calculate the approximate equation by using a method of least squares.

10. The non-transitory computer-readable recording medium according to claim 8, wherein the controlling program causes a computer to execute the steps of:

calculate a coordinate point which is a midpoint between a coordinate point $(V_i, M_i)$ and a coordinate points $(V_{i+1}, M_{i+1})$, where Vi indicates the i-th lowest developing bias (i is a natural number from 1 to (m−1)) among the m developing biases, and $M_i$ indicates the adhesion amount of toner corresponding to Vi, and calculate the approximate equation, further based on the calculated midpoint coordinate point.

11. The non-transitory computer-readable recording medium according to claim 8, wherein the patch forming unit forms two or more test patches with at least one of the m developing biases, wherein the controlling program causes a computer to execute the step of:

determine an average value of the adhesion amounts of toner of the two or more test patches detected, and use the average value as the adhesion amount of toner corresponding to at least one of the developing biases when calculating the approximate equation.

12. The non-transitory computer-readable recording medium according to claim 8, wherein the image forming apparatus further comprises:

a toner image forming unit to form a toner image which extends whole circumference of the photoconductor drum, on a surface of the photoconductor drum, and a toner amount detecting unit to detect distribution of the adhesion amount of toner of the toner image formed by the toner image forming unit, in a circumferential direction of the photoconductor drum, the distribution including a periodic fluctuation, wherein the controlling program causes a computer to execute the step of:

calculate a cycle length of the periodic fluctuation of the adhesion amount of toner adhered to the photoconductor drum in the circumferential direction, based on the distribution detected by the toner amount detecting unit.

13. The non-transitory computer-readable recording medium according to claim 8, wherein the image forming apparatus further comprises:

an intermediate transfer belt, wherein the controlling program causes a computer to execute the step of:

detect the adhesion amounts of toner for the plurality of test patches transferred from the photoconductor drum to a surface of the intermediate transfer belt.

14. The non-transitory computer-readable recording medium according to claim 8, wherein the controlling program causes a computer to execute the step of:

detect the adhesion amount of toner for the plurality of test patches formed on a surface of the photoconductor drum.

15. A method for controlling an image forming device, wherein the image forming device comprising:

a photoconductor drum having a cylindrical shape, a developing device, and a patch forming unit to form a plurality of test patches of a same color, by developing electrostatic latent images formed on a surface of the photoconductor drum with toner, by using the developing device, wherein the method comprises steps to:

form, by the patch forming unit, a plurality of test patches under m developing biases, which are different from each other, detect adhesion amounts of toner of the plurality of test patches formed by the patch forming unit, and calculate an approximate equation which approximates relationship between developing bias of the developing device and an adhesion amount of toner, based on coordinate points configured with the m developing biases of the developing device when the patch forming unit formed the plurality of test patches and the detected adhesion amounts of toner of the plurality of test patches corresponding to the m developing biases, wherein the distance d between an anterior end of a test patch and an anterior end of a next formed test patch is $\{(2n-1)/2\}$ times of value L, among test patches formed by the patch forming unit, where n is a natural number, and value L is a length of the photoconductor drum in a circumferential direction, or a cycle length of fluctuation of the adhesion amount of toner which adheres to the photoconductor drum in a circumferential direction, and a controlling means to calculate a value of the developing bias corresponding to a target adhesion amount by using the calculated approximate equation, and form an image by using the calculated value of the developing bias.

16. The image forming apparatus according to claim 1, wherein the photoconductor drum exhibits rotational unevenness due to an eccentricity.

17. The image forming apparatus according to claim 1, wherein a distance between the photoconductor drum and the developing roller of the developing device fluctuates periodically during rotation of the photoconductor drum.

18. The image forming apparatus according to claim 1, wherein a distance d between the anterior end of every test patch is $\{(2n-1)/2\}$ times of value L.

19. An image forming apparatus, comprising:

the photoconductor drum including a photosensitive surface having a cylindrical shape, an exposure unit to form an electrostatic latent image on the photosensitive surface of the rotating photoconductor drum, a developing device for developing the formed electrostatic latent image with toner under a predetermined developing bias, a forming means to form a plurality of test patches of a same color at an interval d, by developing electrostatic latent images formed on the photosensitive surface by the developing device under m developing biases, which are different from each other, the interval d is $\{(2n-1)/2\}\times L$, where L is a length of the photoconductor drum in a circumferential direction, a patch detecting means to detect adhesion amounts of toner of the plurality of test patches formed, a calculating means to calculate an approximate equation which approximates a relationship between the developing bias used for forming the plurality of test patches and an adhesion amount of toner of the plurality of test patches, based on coordinate points configured with the m developing biases and the detected adhesion amounts corresponding to the m developing biases, and a controlling means to calculate a value of the developing bias corresponding to a target adhesion amount by using the calculated approximate equation, and form an image by using the calculated value of the developing bias.

* * * * *